United States Patent [19]

Mosé et al.

[11] 4,253,932

[45] Mar. 3, 1981

[54] UNITARY FRAME AND MEMBRANE FOR ELECTROLYTIC CELLS

[75] Inventors: Luciano Mosé, Dortmund; Helmut Schurig, Holzwickede; Bernd Strasser, Hamm, all of Fed. Rep. of Germany

[73] Assignee: Hooker Chemicals & Plastics Corp., Niagara Falls, N.Y.

[21] Appl. No.: 39,991

[22] Filed: May 17, 1979

[30] Foreign Application Priority Data

May 19, 1978 [DE] Fed. Rep. of Germany ..... 2821982

[51] Int. Cl.[3] ..... C25B 9/00; C25B 13/02; C25B 13/08

[52] U.S. Cl. ..... 204/253; 204/279; 204/296

[58] Field of Search ..... 204/279, 295, 296, 253, 204/254–258, 263–266, 252, 180 P; 52/222, 827

[56] References Cited

U.S. PATENT DOCUMENTS

| | | | |
|---|---|---|---|
| 1,272,397 | 7/1918 | Dohmen | 204/256 |
| 1,464,840 | 8/1923 | Allan | 204/256 |
| 2,522,661 | 9/1950 | Bowen | 204/279 |
| 2,867,575 | 1/1959 | De Jong | 204/296 |
| 3,312,614 | 4/1967 | Schick | 204/257 X |
| 3,484,356 | 12/1969 | Goujard | 204/180 P |
| 4,142,950 | 3/1979 | Creamer et al. | 204/296 X |
| 4,175,025 | 11/1979 | Creamer et al. | 204/279 X |

FOREIGN PATENT DOCUMENTS

| | | | |
|---|---|---|---|
| 1078129 | 8/1967 | United Kingdom | 204/254 |

*Primary Examiner*—Howard S. Williams
*Assistant Examiner*—D. R. Valentine
*Attorney, Agent, or Firm*—Peter F. Casella; Howard M. Ellis

[57] ABSTRACT

A unitary frame and membrane assembly particularly useful in a filter press electrolytic cell arrangement is provided by the present invention. The assembly comprises a rigid, peripheral frame member having separable peripheral frame portions. A permselective membrane member is positioned between the separable peripheral frame portions, and the membrane member and frame portions are secured together to form a unitary frame and membrane assembly. The present assembly is adapted for use as the barrier component in electrolytic cells which utilize a separatory membrane barrier between the cell electrodes.

9 Claims, 4 Drawing Figures

UNITARY FRAME AND MEMBRANE FOR ELECTROLYTIC CELLS

BACKGROUND OF THE INVENTION

The present invention relates to the construction of improved electrolytic cells useful as units of a filter press cell arrangement. More particularly, the present invention relates to a unitary frame and membrane member which facilitates cell assembly and membrane replacement. Electrolytic cells are particularly useful in the electrolysis of alkali metal chloride, such as sodium chloride, to produce alkali metal hydroxides, such as sodium hydroxide, together with chlorine and hydrogen.

A filter press arrangement typically consists of a plurality of separate cell units having planar electrode elements generally mounted in a vertical position separated along their active faces by a barrier, such as a diaphragm or membrane layer. The filter press cell units may be monopolar or bipolar and may be appropriately connected in series or parallel to form a cell circuit or bank.

Chlorine and alkali metal hydroxides are essential and large volume commodities as basic industrial chemicals. Plants producing 500 to 1000 tons of chlorine per day are not uncommon. Such plants typically utilize a large number of individual electrolytic cells having current capacities of several hundred thousand amperes. Thus, minor improvements in individual cell operation or performance have major economic benefits because of the volume of the products produced.

Upon the application of direct, electrolyzing current to an electrolytic cell containing an aqueous solution of an alkali metal chloride as the electrolyte, hydrogen and alkali metal hydroxide are produced at the cathode, and chlorine is produced at the anode.

Electrolytic cells that are commonly employed commercially for the conversion of alkali metal halides into alkali metal hydroxides and halides may be considered to fall into the following general types: (1) diaphragm, (2) mercury and (3) membrane cells.

Diaphragm cells utilize one or more diaphragms permeable to the flow of electrolyte solution but impervious to the flow of gas bubbles. The diaphragm separates the cell into two or more compartments. Although diaphragm cells achieve relatively high product per unit floor space, at low energy requirements, and at generally high current efficiency, the alkali metal hydroxide product, or cell liquor, must be concentrated and purified. Such concentration and purification is usually accomplished by a subsequent evaporation step.

Mercury cells typically utilize a moving or flowing bed of mercury as the cathode and produce an alkali metal amalgam in the mercury cathode. Halide gas is produced at the anode. The amalgam is withdrawn from the cell and treated with water to produce a high purity alkali metal hydroxide.

Membrane cells utilize one or more membranes or barriers separating the catholyte and the anolyte compartments. The membranes are permselective, that is, they are selectively permeable to either anions and cations. Generally, the permselective membranes utilized are cationically permselective. Usually, the catholyte product of the membrane cell is relatively high purity alkali metal hydroxide ranging in concentration from about 250 to about 350 grams per liter.

The introduction of dimensionally stable anodes has permitted ever narrowing of the space, or gap, between the electrodes of a cell, thereby facilitating progressively higher cell efficiency. The advent of dimensionally stable anodes and suitable membrane materials has made possible the construction of electrolytic cells having a thin separating partition positioned between planar electrodes, and the combination of a number of individual cell units, usually between about 10 and about 100, to form a cell circuit or bank arranged in the manner of a filter press. For example, in the case of a monopolar arrangement, the components typically would comprise a plurality of anodes mounted in anode frames and cathodes mounted in cathode frames. The anodes and cathodes are separated along their active faces by a permeable barrier, or membrane, and along the inner periphery of the frames by a pliable or elastic gasket member. The assembly is completed by coupling or pressing the components together, hydraulically or by means of threaded connectors, such as tie rods, to compress the gasket members to form gas and liquid-tight seals between the individual units.

The term "membrane", as used herein, is meant to encompass separating partitions or barriers in the form of sheets or fabrics of chemically resistant materials which are ion conducting, for example, permselective resin materials, asbestos fibers, mixtures thereof, and includes microporous materials.

From time to time during the operation of electrolytic cells equipped with a membrane barrier, the membrane component requires replacement. The replacement process typically entails removal of the cell circuit from service, disassembly of the circuit, disassembly of the individual cell unit, removal and replacement of the membrane and the subsequent reassembly of the components into an operative cell circuit. However, the membrane is typically attached to an electrode member, by clamping or other means, and the membrane replacement operation requires the time-consuming steps of removing the usually heavy electrode member, generally by a lifting means, removal of the membrane, positioning and clamping the new membrane on the electrode member and the replacement and repositioning of the electrode member in the cell circuit.

Although the present invention provides a means of shortening the time required to initially assemble a cell circuit, its more important aspect is that the present invention substantially shortens the down time required for replacement of membranes in operating circuits, thereby substantially increasing the production time.

GENERAL DESCRIPTION OF THE INVENTION

A unitary frame and membrane assembly particularly useful in a filter press electrolytic cell arrangement is provided by the present invention. The assembly comprises a rigid, peripheral frame member having separable peripheral frame portions. A permselective membrane member is positioned between the separable peripheral frame portions, and the membrane member and frame portions are secured together to form a unitary frame and membrane assembly. The present assembly is adapted for use as the barrier component in electrolytic cells which utilize a separatory membrane barrier between the cell electrodes.

The frame portions of the present frame member are rigid, that is, they are substantially dimensionally stable when hand-held. In assembling the present unit, the membrane member is initially sandwiched between the separated frame portions, the frame portions are aligned, and the membrane and frame portions secured together by suitable fastening means, such as threaded connectors or by a tongue and groove arrangement in the frame portions, to provide a rigid frame and membrane assembly.

Assemblies of the present invention may be replaced in a cell circuit without completely disassembling the circuit. The circuit clamping or holding means, for example, tie rods, are loosened, the faulty membrane mounted in its frame and membrane assembly is removed and a new assembly substituted. The circuit is then reclamped and placed back in service. The present invention is particularly useful in that it facilitates storage of prepared, spare membrane components. In cases where the membrane material is to be chemically treated prior to placing the membrane in service, the present invention allows the mounted membrane to be pretreated and stored ready for use, or, if desired, the frame and membrane assembly may be stored in a suitable treatment liquid until the assembly is needed.

BRIEF DESCRIPTION OF THE DRAWING

The present invention will now be explained in detail by reference to the accompanying drawings. The drawings are illustrative of the present invention and are not to be construed as limiting the invention to the particular mode shown.

DETAILED DESCRIPTION OF THE INVENTION

Figure 1:
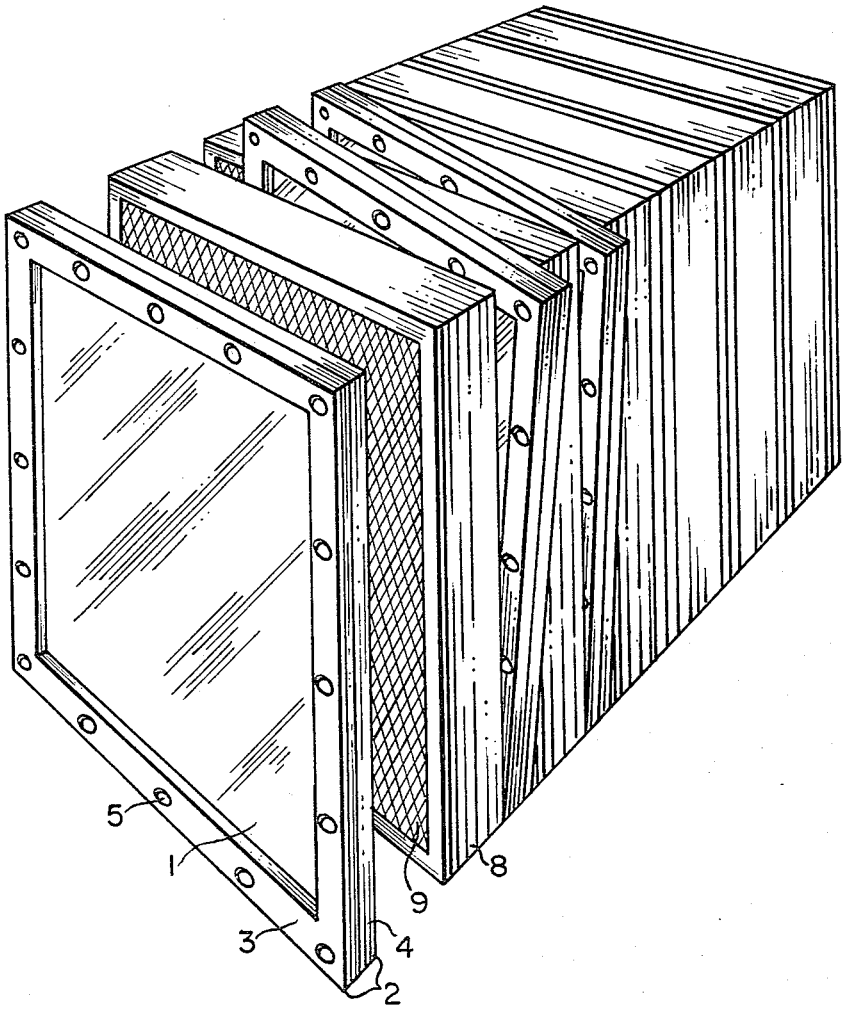
FIG. 1 is a perspective view of a portion of an unassembled circuit of electrolytic cells in a filter press arrangement showing the relative positioning of the present unitary frame and membrane assembly.

Looking now at FIG. 1, the unitary frame and membrane assembly consists of flat membrane 1 mounted around its periphery in rigid peripheral frame member 2. As shown in FIG. 1, frame member 2 consists of separable portions 3 and 4 adapted to receive and hold membrane 1 therebetween. Frame portions 3 and 4 are secured together by fastening means, suitably screws or bolts 5. The circuit components include a plurality of electrode members, such as 8, having active faces, such as 9. The present frame and membrane assemblies are adapted to be positioned between, and to separate, adjacent electrode members. A circuit of cells may be assembled by placement of suitable gaskets between each of the individual components, compressing or clamping the whole to form a plurality of separate cell units, each having a pair of electrodes separated by a frame and membrane assembly.

Figure 2:
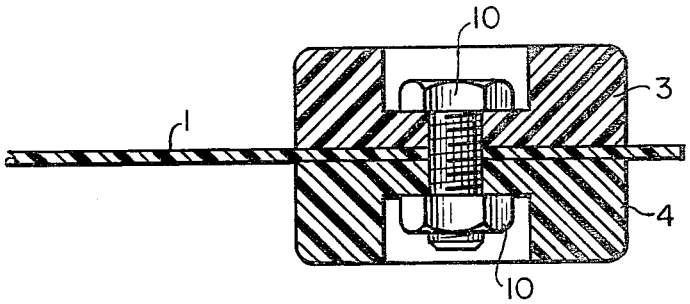
FIGS. 2, 3 and 4 are partial, cross-sectional and elevational views showing various embodiments of means for securing the frame portions and membrane in the frame and membrane assembly.

FIG. 2 shows in detail a portion of a frame and membrane assembly, such as shown in FIG. 1, fastened with threaded connectors around the periphery of the frame member. Frame portions 3 and 4 with membrane member 1 mounted therebetween are joined together with bolt 10 and nut 11. In order that the sides of the frame member present a relatively flat surface to facilitate cell assembly, it is preferred that frame portions 3 and 4 be recessed in the areas adapted to receive bolt 10 and nut 11.

Figure 3:
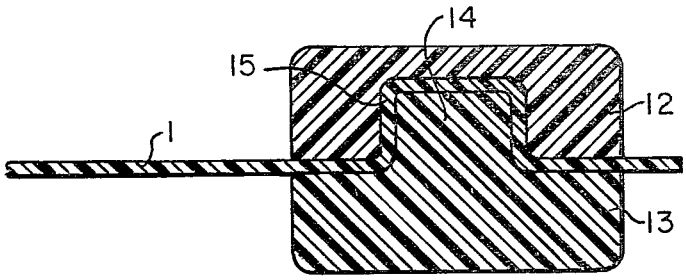

FIG. 3 shows an alternative means of mounting membrane 1 in the frame member. In this mode, frame portions 12 and 13 clamp membrane 1 between peripheral tongue portion 14 and peripheral groove portion 15. Tongue and groove portions 14 and 15 are preferably fabricated to tightly fit together in an interlocking manner. Areas of frame portions 12 and 13 in locking contact with membrane 1 are preferably rounded in order that damage to the membrane is not incurred.

Figure 4:
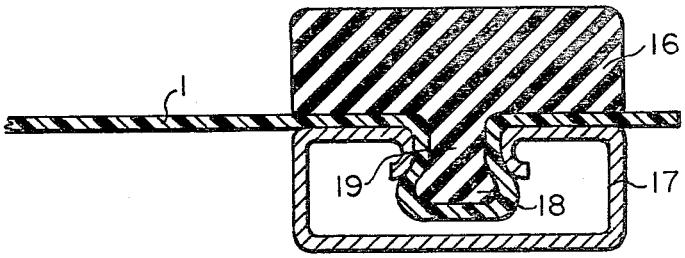

FIG. 4 shows a further means of mounting membrane 1 in the frame. In this embodiment, membrane 1 is clamped between frame portions 16 and 17. Frame portion 16 is fabricated of a non-conducting material and has a peripheral projection 18. Frame portion 17 is fabricated of metal having spring properties and is sized to tightly fit periphery projection 18. Projection 18 may be tapered slightly outward towards its outer surface to provide constricted portion 19 along its inner peripheries. Constricted portion 19 provides a means of snap fitting frame portions 16 and 17 together. Preferably, all corners of frame portions 16 and 17 which come in contact with membrane 1 are rounded to avoid damaging the membrane during clamping of the membrane and frame portions.

In order to provide electrical insulation between cell components, at least one portion of the present frame member is fabricated of a suitable non-conducting material. Non-conductive plastic materials which are resistant to corrosion by the electrolyte and can withstand the operating temperatures of the cell can be used. Examples of such suitable materials are various thermoplastic or thermosetting resins, such as polypropylene, polybutylene, polytetrafluoroethylene, after chlorinated or rigid FEP, chlorendic acid based polyesters, and the like.

Membranes suited to use in the present invention include those fabricated of a hydrolyzed copolymer of a perfluorinated hydrocarbon and a sulfonated perfluorovinyl ether. More specifically, such suitable membrane materials are fabricated of a hydrolyzed copolymer of tetrafluoroethylene and a fluorosulfonted perfluorovinyl ether of the general formula: $FSO_2CF_2CF_2OCF(CF_3)CF_2OCF{=}CF_2$. Normally, the membrane wall thickness will range from about 0.02 to about 0.5 mm., and, preferably, from about 0.1 to about 0.3 mm. When mounted on polytetrafluoroethylene, asbestos, or other suitable network for support, the network filaments or fibers will usually have a thickness of from about 0.01 to about 0.5 mm., and, preferably, from about 0.05 to about 0.15 mm.

While there have been described various embodiments of the invention, the apparatus described is not intended to be understood as limiting the scope of the invention as it is realized that changes therewithin are possible, and it is intended that each element recited in any of the following claims is to be understood as referring to all equivalent elements for accomplishing the same results in substantially the same or equivalent manner, it being intended to cover the invention broadly in whatever form its principle may be utilized.

What is claimed is:

1. A separatory barrier for use between electrodes of a filter press type electrolytic cell comprising a rigid frame member having a pair of independent and separate frame portions and a permselective membrane disposed between opposing surfaces of each portion, said frame member adapted to hold the membrane on its peripheral edges, said frame portions and membrane detachably secured forming an independent frame and membrane assembly which can be easily removed from the cell and disassembled for membrane replacement without disassembly of adjacent electrode members wherein the peripheral edges of the membrane are in continuous contact with the entire opposing surfaces of each of said frame portions effecting complete separation thereof.

2. The frame and membrane assembly of claim 1 wherein said frame portions and said membrane member are secured by threaded connectors.

3. The frame and membrane assembly of claim 1 wherein at least one of said frame portions is fabricated of a non-conducting material.

4. The separatory barrier of claim 1 wherein the permselective membrane is a hydrolyzed copolymer of tetrafluoroethylene and a fluorosulfonated perfluorovinyl ether of the formula:

$FSO_2CF_2CF_2OCF(CF_3)CF_2OCF{=}CF_2$.

5. The separatory barrier of claim 4 installed in a chlor-alkali cell.

6. A frame for mounting a permselective membrane for use as a separatory barrier between electrodes of a filter press type electrolytic cell comprising a rigid frame member having a pair of independent and separate frame portions, said frame member adapted to hold the membrane on its peripheral edges, said frame equipped with means for detachably securing both frame portions together when the membrane is placed between opposing surfaces of said portions forming a frame and membrane assembly which can be easily removed from the cell and disassembled for membrane replacement without disassembly of adjacent electrode members wherein the peripheral edges of the membrane effect complete separation of the frame portions by continuous contact with the entire opposing surfaces of each of said frame portions.

7. The frame of claim 6 wherein the frame portions are secured by threaded connectors.

8. A separatory barrier for use between electrodes of a filter press type electrolytic cell comprising a rigid peripheral frame member having a pair of independent and separate frame portions and a permselective membrane disposed between opposing surfaces of each frame portion, said frame portions and membrane detachably secured by a tongue and groove arrangement forming a frame and membrane assembly which can be easily disassembled for membrane replacement wherein the membrane of the assembly is in continuous contact with the entire opposing surfaces of each of said frame portions effecting complete separation thereof.

9. A frame for mounting a permselective membrane for use as a separatory barrier in an electrolytic cell comprising a rigid peripheral frame member having a pair of independent and separate frame portions, said frame equipped with a tongue and groove arrangement for detachably securing both frame portions together when the membrane is placed between opposing surfaces of said frame portions forming a frame and membrane assembly which can be easily disassembled for membrane replacement, said frame being adapted whereby the membrane of the assembly effects complete separation of the frame portions by continuous contact with the entire opposing surfaces of each of said frame portions.

* * * * *